US007249697B2

(12) United States Patent
Gouldson

(10) Patent No.: US 7,249,697 B2
(45) Date of Patent: Jul. 31, 2007

(54) GARMENT HANGER WITH CENTRAL SUPPORT RIB

(75) Inventor: Stanley Gouldson, Northport, NY (US)

(73) Assignee: Spotless Plastics Pty. Ltd., Moorabbin, Victoria (AU)

( * ) Notice: Subject to any disclaimer, the term of this patent is extended or adjusted under 35 U.S.C. 154(b) by 0 days.

(21) Appl. No.: 11/391,047

(22) Filed: Mar. 28, 2006

(65) Prior Publication Data

US 2006/0278670 A1 Dec. 14, 2006

Related U.S. Application Data

(60) Provisional application No. 60/665,940, filed on Mar. 29, 2005.

(51) Int. Cl.
*A41D 27/22* (2006.01)

(52) U.S. Cl. ..... 223/85

(58) Field of Classification Search ..... 223/85–98
See application file for complete search history.

(56) References Cited

U.S. PATENT DOCUMENTS

| | | | | |
|---|---|---|---|---|
| 3,856,190 | A * | 12/1974 | Mole et al. | 223/94 |
| 4,026,447 | A * | 5/1977 | Wnek | 223/98 |
| 4,046,293 | A * | 9/1977 | Garrison | 223/88 |
| 4,185,768 | A * | 1/1980 | Treiman | 223/85 |
| 4,266,677 | A * | 5/1981 | Dewsnap | 211/45 |
| 4,739,912 | A * | 4/1988 | Klawieter et al. | 223/85 |
| 5,052,599 | A * | 10/1991 | Platti | 223/89 |
| 5,071,045 | A | 12/1991 | Hollis | |
| 5,289,956 | A * | 3/1994 | Petrou | 223/85 |
| 5,503,311 | A * | 4/1996 | Chen | 223/85 |
| 5,584,421 | A * | 12/1996 | Blanchard et al. | 223/94 |
| 5,601,219 | A * | 2/1997 | Chen | 223/85 |
| 6,241,133 | B1 * | 6/2001 | Morgan et al. | 223/96 |
| 6,286,735 | B1 * | 9/2001 | Zuckerman | 223/96 |
| 2004/0112929 | A1 * | 6/2004 | Frassinelli | 223/85 |
| 2007/0029354 | A1 * | 2/2007 | Hunt et al. | 223/85 |

FOREIGN PATENT DOCUMENTS

AU 198321403 A1 5/1984

* cited by examiner

*Primary Examiner*—Shaun R. Hurley
(74) *Attorney, Agent, or Firm*—Scully, Scott, Murphy & Presser

(57) ABSTRACT

An easily and inexpensively manufactured garment hanger of increased strength and durability. The garment hanger comprises a suspension hook secured to a support rib provided at a central hook region of the hanger. Incorporating the support rib through the central hook region of the hanger minimizes twist and other distortions of the hanger, even when under heavy garment loads.

30 Claims, 4 Drawing Sheets

GARMENT HANGER WITH CENTRAL SUPPORT RIB

CROSS-REFERENCE TO RELATED APPLICATIONS

Under 35 U.S.C. § 119(e), this application claims priority of U.S. Provisional Patent Application Ser. No. 60/665,940 filed 29 Mar. 2005, entitled Garment Hanger with Central Support Rib the disclosure of which is hereby incorporated by reference in its entirety for all purposes.

BACKGROUND OF THE INVENTION

1. Field of the Invention

The invention generally relates to garment hangers. More specifically, the invention relates to molded plastic garment hangers having a rib support structure at an interface of shoulder, arm and central hook regions of the hanger.

2. Related Art

Garment hangers have been known and used for years. Historically, as shown in FIG. 1, the basic garment hanger 1 was wire or wooden having opposed shoulders 2 joined at a central hook region 3. A suspension hook 4 projects from the central hook region 3 permitting the hanger 1 to be placed on a rod or other structure for storage in a closet, for example. From the central hook region 3, the opposed shoulders 2 each extend outwardly as arms 5 terminating at opposed ends 6 thereof. The opposed ends 6 of the arms 5 are often joined by a cross-member 7 extending between the opposed ends 6 to increase the strength and stability of the hanger.

Though the strength and durability of the wooden hangers, in particular, were appealing, the increased costs and additional weight of the wooden hangers resulted in the development of less expensive and lighter weight plastic hangers, such as those disclosed in Australian Patent No. 544211 (AU-B-21403/83) or U.S. Pat. No. 5,071,045 that are commonly-owned herewith.

The arms of such molded plastic hangers tend to bend at transition regions, such as between the central hook and shoulder regions, the shoulder and arm regions, or other transition regions when heavier garments are placed on the hanger. Moreover, where less flexible material, such as general purpose polystyrene, has been used to comprise the molded plastic hangers, the transition regions may even break under heavy garment loads.

To overcome the tendency to bend or break at transition regions, arms of molded plastic hangers have been reinforced with channel inserts or I-sections placed throughout, or at various intervals over or within, the arms as described in the above-mentioned commonly-owned patents. The channel inserts or I-sections may be co-molded with, or separately inserted on or into, the arms of the hangers. In any event, incorporation of such channel inserts or I-sections throughout, or at various intervals of, the arms of the hanger increase the time and costs to manufacture such hangers.

Additionally, the co-molding or other provision of the channels or I-sections to the arms of the hangers often cause rippling or other undesirable marring of exposed surfaces of the arms of the hangers, particularly where the channels or I-sections are located only at various intervals of the arms of the hangers. Collapsing or pinching of all or portions of sidewalls of the arms of the hangers have also been found to occur in some, particularly where the channels or I-sections are provided on an external surface of the arms or are provided at various intervals on or within the arms of the hangers. Moreover, experiments have shown that the use of such channel inserts or I-sections tend still to create regions of weakness in the hanger. The weak regions render the hangers susceptible to bending or breaking as before, particularly at the transition region between the central hook and shoulder regions, when the hanger experiences heavy loads.

Further efforts to overcome the tendency to bend or break at transition regions include co-molding U-shaped channels or depressions in an external surface of the central hook region of the hanger, whereat the shoulders converge as shown in the commonly-owned U.S. Pat. No. 5,071,045 discussed above, for example. The external channels or depressions are intentionally isolated from the channels of the arms, however, which renders the hangers susceptible to twisting. Such twisting can result in bending or breaking of the hanger as well.

In view of the above, a need exists for an easily and inexpensively manufactured molded plastic garment hanger having increased strength and durability at the interface of the central hook, shoulder and arm regions of the hanger.

SUMMARY OF THE INVENTION

The garment hanger according to the invention provides a molded plastic garment hanger incorporating a single support rib in the hanger where a central hook region interfaces with shoulder and arm regions of the hanger.

In a preferred embodiment of the invention, the support rib is co-molded into the central hook region between panels comprising shoulders and arms of the hanger. Alternatively, the support rib may be separably inserted and glued, or otherwise secured, in the central hook region of the hanger between the panels comprising the shoulders and arms of the hanger. In either case, the support rib is provided between an underside surface of the panels comprising the arm, shoulder and central hook regions of the hanger.

Positioning the support rib between the underside of the various panels at a single location minimizes rippling, waving or other undesirable distortions or marring of the exposed surfaces of the hanger. Further, the use of a single support rib minimizes the time and costs associated with making the hanger according to the invention. Moreover, because the support rib of the invention extends between panels comprising the arm, shoulder and central hook regions, increased stability is provided to the hanger notwithstanding the absence of additional reinforcing channels or I-sections on or in the hanger arms as in prior art hangers.

According to the invention, the support rib is comprised of a receiving end and a closed end opposite thereof, the receiving end and the closed end being connected by a balance of the support rib. A portion of the receiving end is exposed as it projects from the hanger slightly above the central hook region of the hanger. The support rib thus extends from its exposed receiving end above the central hook region of the hanger through the shoulder region and into the arm region of the hanger. In a preferred embodiment, the receiving end of the support rib is threaded in order to receive a correspondingly threaded portion of a suspension hook provided with the hanger. The balance of the support rib generally extends from the receiving end thereof at the central hook region through the shoulder region and into, or through, the arms of the hanger.

By extending through the hanger in this manner at the interface of the arm, shoulder and central hook regions, the support rib resists twisting even under heavy garment loads. Wings are provided to connect the exposed portion of the receiving end of the support rib to the hanger to increase the resistance to twisting and to provide even greater strength and stability therefore. Incorporating the support rib into a garment hanger according to the invention thus provides a garment hanger of increased strength and stability that is easy and inexpensive to manufacture.

The artisan will appreciate that the support rib may be configured of various shapes, wherein a particularly preferred shape is an I-shaped support rib except for the receiving end, which is round in order to receive the threaded portion of the suspension hook. Of course, the artisan will also readily appreciate that the support rib may be provided with a non-threaded receiving end for receiving a non-threaded portion of the suspension hook. In this latter case, the entire support rib may be comprised of a common shape, wherein the receiving end is configured to receive a portion of the suspension hook. Where the receiving end and suspension hook are not threaded, the suspension hook is friction-fitted, glued, or otherwise secured in the receiving end of the support rib in accordance with the invention.

The above and other features of the invention, including various novel details of construction and combinations of parts, will now be more particularly described with reference to the accompanying drawings and claims. It will be understood that the various exemplary embodiments of the invention described herein are shown by way of illustration only and not as a limitation thereof. The principles and features of this invention may be employed in various alternative embodiments without departing from the scope of the invention.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE INVENTION

Figure 1:
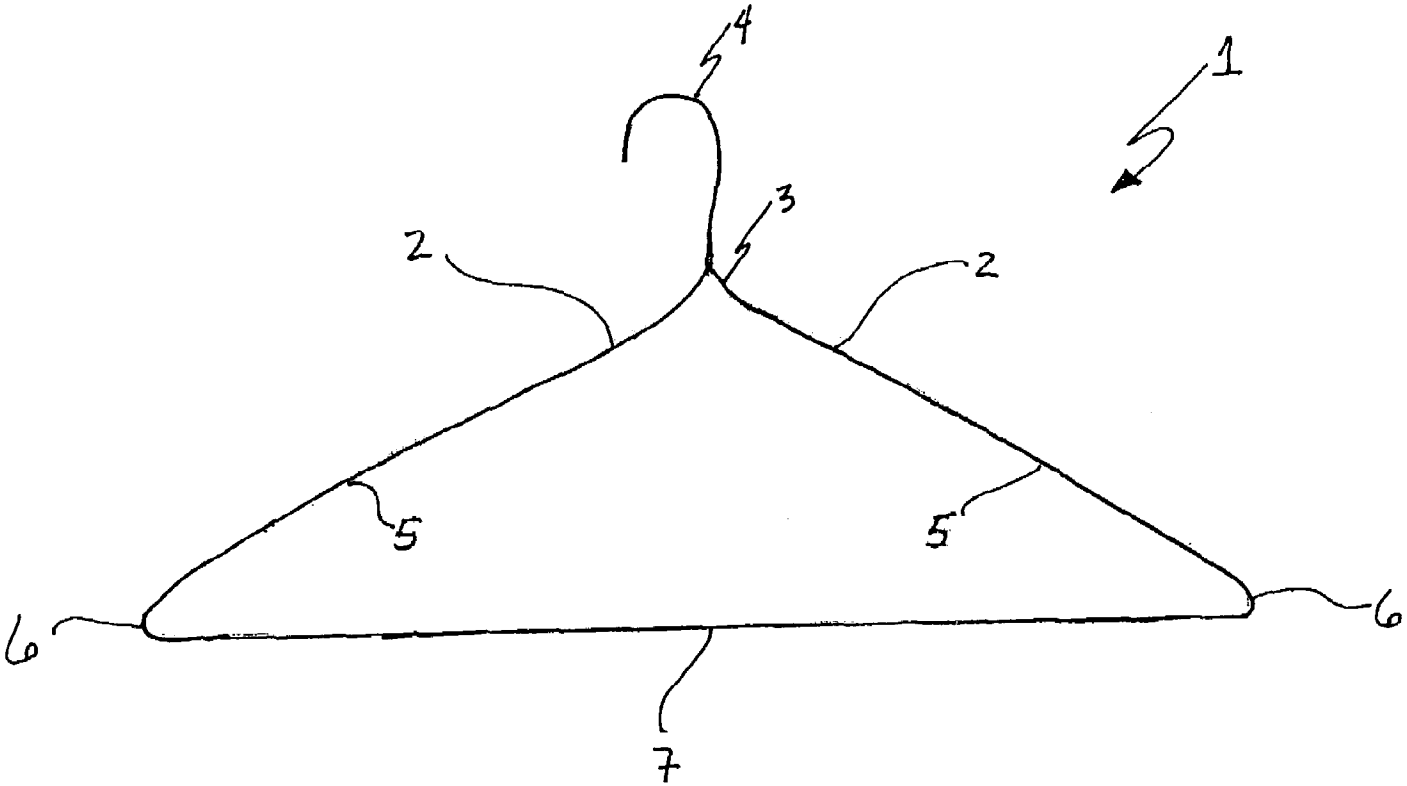
Fig. 1 Prior Art
FIG. 1 illustrates a representation of a prior art hanger.
Figure 2:
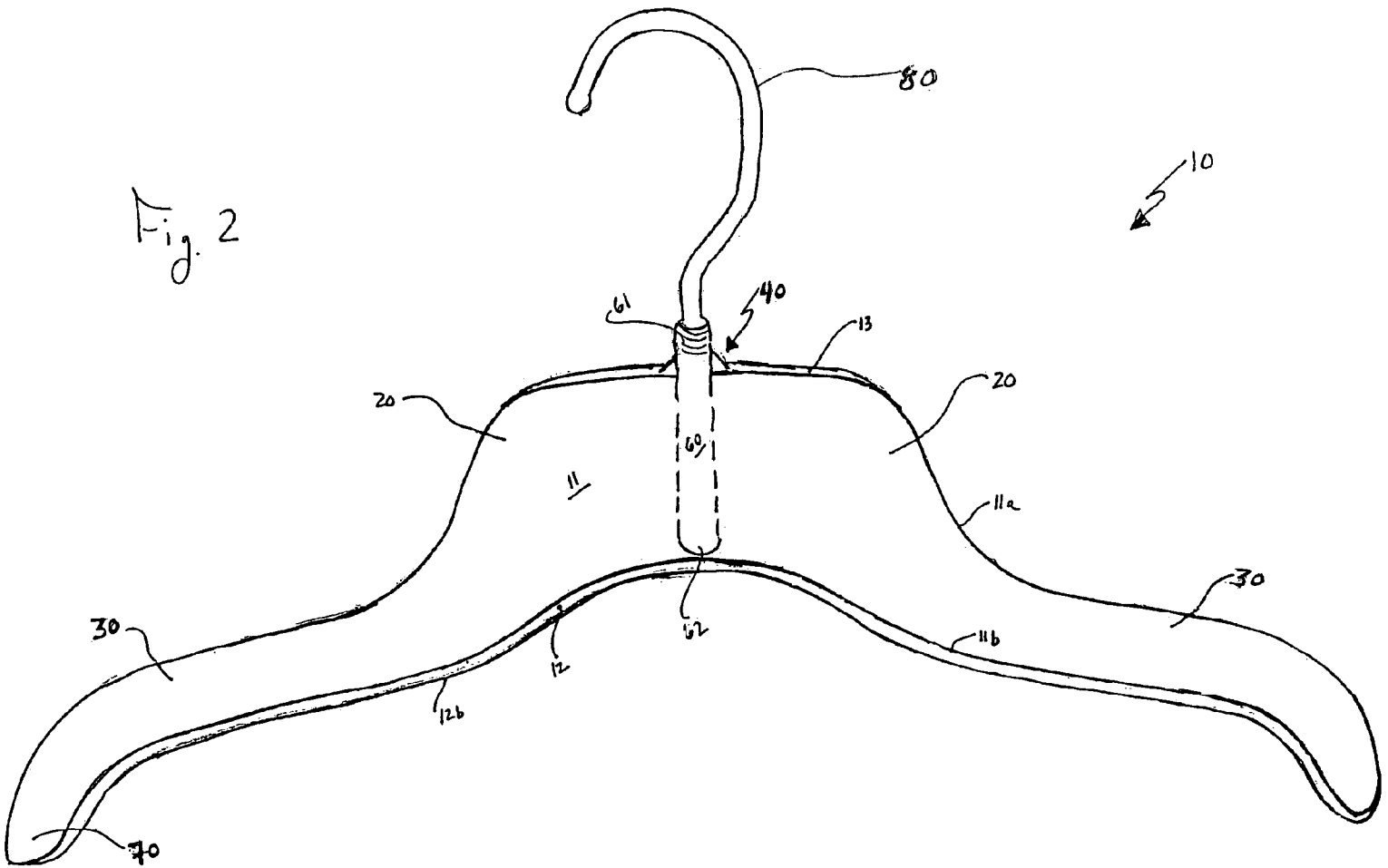
FIG. 2 illustrates a perspective view of a garment hanger according to the invention.

FIG. 2 illustrates a perspective view of a generally open-channeled garment hanger 10 according to the invention. The garment hanger 10 comprises a shoulder region 20, an arm region 30, and a central hook region 40. The shoulder, arm and central hook regions are formed generally as an inverted unshaped channel from a first panel 11 and a second panel 12 joined by a third panel 13.

The first panel 11 has an upper edge 11*a* and a lower edge 11*b*. The second panel has an upper edge (12*a* not shown) and a lower edge 12*b* that generally correspond to the upper edge 11*a* and the lower edge 11*b* of the first panel, respectively. The second panel 12 is positioned substantially parallel to and spaced apart from the first panel 11, wherein the third panel 13 joins the first panel 11 and the second panel 12 along the respective upper edges 11*a* and 12*a* thereof. Joining the first panel 11 and the second panel 12 with the third panel 13 in this manner helps to maintain the first panel 11 and the second panel 12 in spaced relation relative to one another and generally provides the intended inverted u-shaped channel throughout the shoulder, arm and central hook regions as discussed above.

Referring still to FIG. 2, the shoulder regions 20 of the joined first, second and third panels 11, 12 and 13 converge at the central hook region 40 of the hanger 10, whereat a centrally oriented support member comprising a support rib 60 is located. The joined panels 11, 12 and 13 extend outwardly from the central hook region 40 to form the shoulder regions 20 and downwardly sloping arms 30 of the hanger. Each arm 30 terminates at a respective end 70.

Referring still to FIG. 2, the centrally oriented support rib 60 is provided with a receiving end 61 and a closed end 62 opposite thereof. The receiving end 61 and the closed end 62 are joined by the balance of the support rib 60 that extends generally vertically downwardly between the receiving and closed ends 61, 62 of the rib 60. An exposed portion of the receiving end 61 of the support rib 60 extends slightly above the third panel 13 of the hanger at the central hook region 30. The balance of the support rib 60, including the closed end 62 thereof, extends downwardly between the first, second and third panels 11, 12 and 13 at the central hook region 40 of the hanger.

In a preferred embodiment, as shown in FIG. 2, the receiving end 61 of the support rib 60 is threaded. Where provided, the threaded receiving end 61 receives a corresponding threaded portion of the suspension hook 80. Of course, the artisan will appreciate that the receiving end 61 could instead be non-threaded, for receiving a correspondingly non-threaded portion of the suspension hook. In this latter case, the suspension hook may be friction fitted, glued, or otherwise secured within the receiving end 61 of the support rib 60.

In the preferred embodiment of the garment hanger 10 according to the invention, the support rib 60 is co-molded with the garment hanger. The artisan should appreciate, however, that the support rib 60 may instead be separately provided and secured to the hanger between the first, second and third panels 11, 12, 13, respectively, through the central hook region 40 as well. In either case, providing the support rib 60 between the first, second and third panels 11, 12, 13 of the hanger at the central hook region 40 improves the stability and strength of the hanger and minimizes the tendency of the hanger to twist when subject to heavy garment loads. Distortions or other marring of exposed hanger panels is minimized as well.

Figure 3:
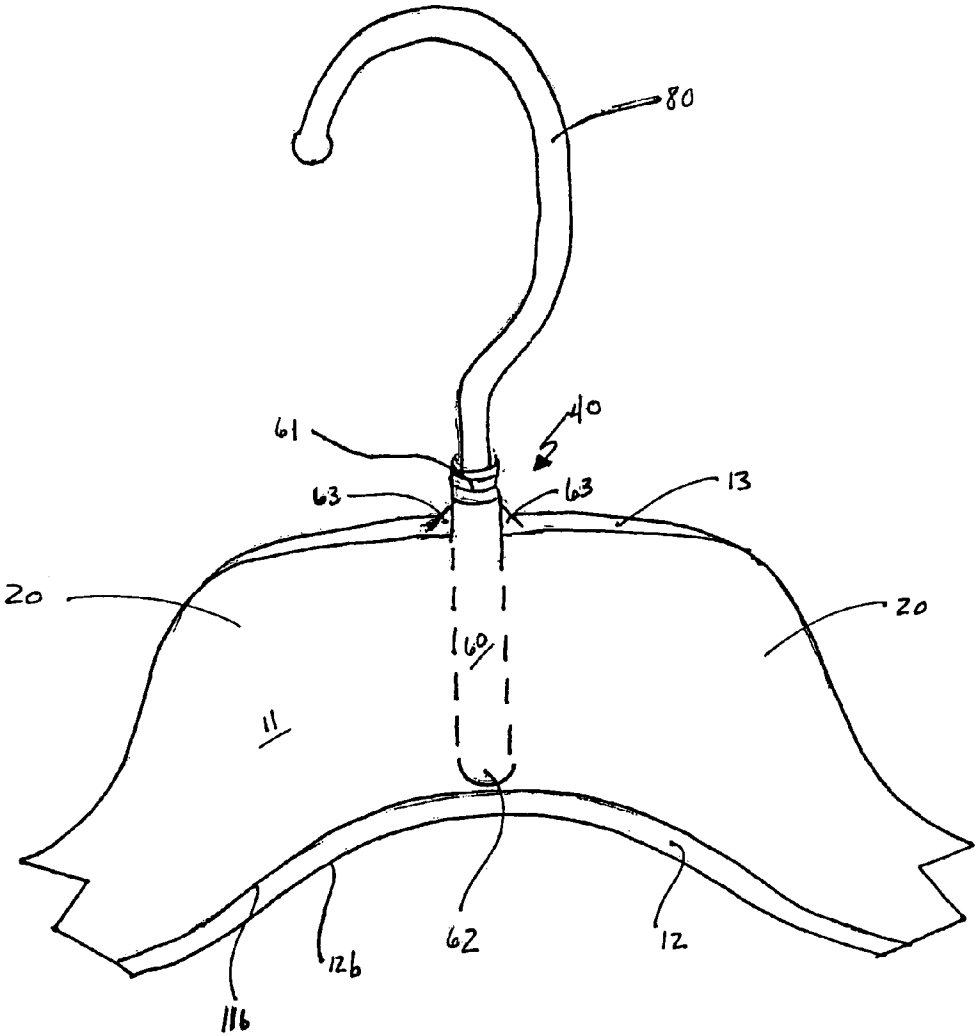
FIG. 3 illustrates a partial perspective view of the central hook region and support rib of the garment hanger according to the invention.

FIG. 3 illustrates in more detail the preferred embodiment of the support rib 60 according to the invention. In particular, FIG. 3 shows, in dashed lines, the support rib 60 as it extends along an underside surface between each of the first, second and third panels 11, 12 and 13 of the hanger. As shown also in FIG. 3, wings 63 project from the exposed portion of the receiving end 61 of the support rib 60 to connect the receiving end 61 to the third panel 13. In the preferred embodiment, the wings 63 are co-molded with the hanger 10 and support rib 60. Whether by co-molding or otherwise, however, connecting the exposed portion of the support rib 60 to the central hook region 40 using the wings 63 minimizes twisting of the hanger 10 and increases the strength and stability of the hanger 10, even when subjected to heavier garment loads. The artisan will readily appreciate that the wings 63 may be comprised of shapes other than as shown and described herein in order to connect the receiving end of the support rib with the hanger.

Referring still to FIG. 3, the support rib 60 extends downwardly from the receiving end 61 to the closed end 62 of the support rib between the first, second and third panels 11, 12, and 13 of the hanger. The closed end 62 of the support rib 60 is shown in FIG. 3 as extending towards, but not to, the lower edges 11*b*, 12*b* of the first and second panels 11, 12 respectively. Of course, as the artisan should readily appreciate, other configurations of the support rib 60 are well within the scope of the invention including those wherein the closed end 62 of the support rib extends to the lower edges 11*b*, 12*b* of the first and second panels 11, 12, or to some other position between the upper edges 11*a*, 12*a* and the lower edges 11*b*, 12*b* of the first and second panels 11, 12, respectively.

Figure 4:
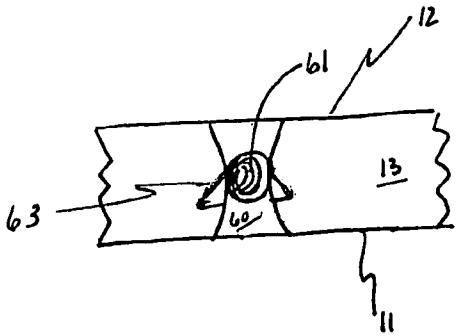
FIG. 4 illustrates a cross sectional top view of the support rib of the garment hanger according to the invention.

FIG. 4 illustrates a cross-sectional top view of the support rib 60 according to the preferred embodiment of the invention. As shown in FIG. 4, the support rib 60 is comprised generally of an I-shaped section, except at its receiving end 61, which is round in order to receive the correspondingly threaded, or other, portion of the suspension hook 80 as discussed above. The support rib 60 is shown between the first, second and third panels 11, 12 and 13, wherein the panels join to form the substantially closed upper portion of the hanger other than the opening provided by the receiving end 61 of the support rib 60. The wings 63 are also shown in FIG. 4. Of course, cross-sectional configurations other than the exclusively I-shaped configuration shown in FIG. 4 may comprise some or all of the support rib, as long as the receiving end 61 is provided to receive the suspension hook as otherwise herein described.

Figure 5:
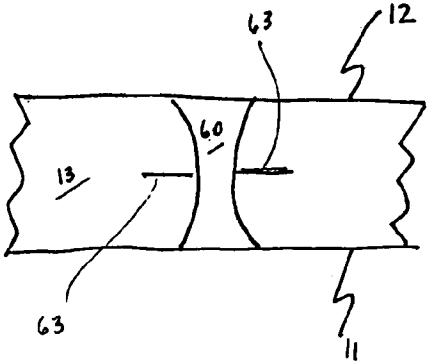
FIG. 5 illustrates a cross-sectional bottom view of the support rib of the garment hanger according to the invention.

FIG. 5 illustrates a cross-sectional bottom view of the support rib 60 according to the preferred embodiment of the invention. As shown in FIG. 5, the generally I-shaped support rib 60 is at or near the lower edges 11*b*, 12*b* of the first and second panels 11, 12. Otherwise, the lower portion of the hanger 10 is open, as evident in FIG. 5 and FIG. 2.

The artisan will appreciate, with respect to the support rib 60, that shapes and configuration other than as shown in the Figures or described herein may also be used provided the support rib generally extends between the first, second and third panels at the interface between the shoulder, arm and central hook regions of the hanger as described herein. For example, the support rib 60 need not have a round threaded receiving end 61 with the balance of the support rib I-shaped. Instead, the receiving end 61 could be non-threaded of a shape for receiving a corresponding non-threaded compliantly shaped portion of the suspension hook 80, in which case the suspension hook 80 could be friction-fitted, glued, or otherwise secured within the receiving end 61 of the support rib 60. Likewise, the artisan should appreciate that the support rib 60 may vary so as to have cross-sections of two or more shapes therein. The artisan will also appreciate that the various panels and components comprising the hanger 10 may be molded from any suitable known or later developed plastic material, including general purpose polystyrene, K-resin, high impact polystyrene, or PETG.

The various exemplary embodiments of the invention as described hereinabove do not limit different embodiments of the present invention. The material described herein is not limited to the materials, designs, or shapes referenced herein for illustrative purposes only, and may comprise various other materials, designs or shapes suitable for the systems and procedures described herein as should be appreciated by one of ordinary skill in the art.

While there has been shown and described what is considered to be preferred embodiments of the invention, it will, of course, be understood that various modifications and changes in form or detail could readily be made without departing from the spirit or scope of the invention. It is, therefore, intended that the invention be not limited to the exact forms described and illustrated herein, but should be construed to cover all modifications that may fall within the scope of the appended claims.

What is claimed is:

1. A garment hanger support member usable with a garment hanger having a suspension hook and a plurality of panels joined to form an inverted u-shaped channel, the support member comprising:

a support rib oriented between the panels of the hanger, the support rib having a receiving end into which a portion of the suspension hook is received, and a closed end extending between the panels of the hanger.

2. The garment hanger support member as in claim 1, further comprising:

at least one wing connecting the receiving end of the support rib to at least one panel of the hanger to minimize twist thereof.

3. The garment hanger support member of claim 2, wherein the support rib is comprised of plastic materials co-molded with the garment hanger.

4. The garment hanger support member of claim 3, wherein the plastic materials are from the group consisting of general purpose polystyrene, K-resin, high impact polystyrene or PETG.

5. The garment hanger support member of claim 3, wherein the support rib is comprised of an I-shaped cross-section.

6. The garment hanger support member of claim 5, wherein the receiving end is round and threaded to receive a correspondingly threaded portion of the suspension hook.

7. The garment hanger support member of claim 5, wherein the receiving end is non-threaded to receive a correspondingly non-threaded portion of the suspension hook.

8. The garment hanger support member of claim 3, wherein the support rib is comprised of a variable cross-section.

9. A garment hanger comprising:

a first panel having a lower edge and an upper edge;

a second panel opposite the first panel and having a lower edge and an upper edge corresponding to the lower edge and the upper edge of the first panel, respectively;

a third panel joining the first panel and the second panel at their respective upper edges to maintain the first panel and the second panel in substantially parallel spaced relation relative to one another;

a support rib extending between the joined panels, the support rib having a receiving end and a closed end opposite the receiving end; and a suspension hook, a portion of the suspension hook being received by the receiving end of the support rib.

10. The garment hanger of claim 9, wherein the joined panels further comprise a central hook region, a shoulder region and an arm region of the hanger.

11. The garment hanger of claim 10, wherein the support rib further comprises an exposed portion extending above the third panel, whereat the receiving end of the support rib is located.

12. The garment hanger of claim 11, further comprising wings connecting the receiving end of the support rib to the hanger.

13. The garment hanger of claim 12, wherein the first panel, second panel, third panel, support rib and wings are comprised of plastic material.

14. The garment hanger of claim 13, wherein the plastic material is one of the group consisting of general purpose polystyrene, K-resin, high impact polystyrene or PETG.

15. The garment hanger of claim 13, wherein the support rib is further comprised of an I-shaped cross-section beginning at the closed end thereof and including a round shaped portion at the receiving end thereof.

16. The garment hanger of claim 15, wherein the receiving end is threaded for receiving a correspondingly threaded portion of the suspension hook.

17. The garment hanger of claim 13, wherein the support rib is comprised of a constant cross-section.

18. The garment hanger of claim 17, wherein the receiving end is non-threaded and receives a correspondingly non-threaded portion of the suspension hook.

19. The garment hanger of claim 13, wherein the support rib is comprised of a variable cross-section.

20. A method of stabilizing a garment hanger, the method comprising:

providing a garment hanger having a suspension hook and a plurality of panels joined in a u-shaped channel configuration;

providing a support rib at least between the plurality of panels, the support rib having a receiving end and a closed end; and securing a portion of the suspension hook within the receiving end of the support rib.

21. The method of claim 20, wherein a portion of the receiving end of the support rib is exposed and extends beyond a closed portion of the u-shaped channel.

22. The method of claim 21, wherein providing the support rib further comprises providing wings connecting the exposed portion of the receiving end of the support rib with the hanger.

23. The method of claim 22, wherein the receiving end is threaded and securing the portion of the suspension hook further comprises threading the portion of the suspension hook into the receiving end of the support rib.

24. The method of claim 20, wherein securing the portion of the suspension hook comprises one of friction fitting or gluing the portion of the suspension hook within the receiving end.

25. The method of claim 20, wherein providing the support rib further comprises providing a support rib of an I-shaped cross-section except for the receiving end thereof.

26. The method of claim 20, wherein providing the support rib further comprises providing a support rib extending from above a closed end of the u-shaped channel at the receiving end of the support rib towards free ends of the u-shaped channel at the closed end of the support rib.

27. The method of claim 26, wherein the closed end of the support rib extends to the free ends of the u-shaped channel.

28. The method of claim 20, wherein providing the support rib further comprises providing the support rib at a central hook region of the hanger between the panels.

29. The method of claim 20, further comprising co-molding the support rib with the panels of the garment hanger.

30. The method of claim 29, wherein providing the garment hanger further comprises providing the plurality of panels that are comprised of at least one of polystyrene, K-resin, high impact polystyrene or PETG.

* * * * *